US005485673A

United States Patent [19]

Lau

[11] Patent Number: 5,485,673

[45] Date of Patent: Jan. 23, 1996

[54] ENVIRONMENTAL CONNECTOR

[75] Inventor: Frederick L. Lau, Skokie, Ill.

[73] Assignee: Switchcraft Inc., Chicago, Ill.

[21] Appl. No.: 260,595

[22] Filed: Jun. 16, 1994

[51] Int. Cl.[6] ..... H01R 43/00

[52] U.S. Cl. ..... 29/883; 439/271; 439/589; 264/267

[58] Field of Search ..... 29/883, 527.3; 439/589, 587, 271, 275, 736, 278; 264/259, 267, 274, 275

[56] References Cited

U.S. PATENT DOCUMENTS

| | | | |
|---|---|---|---|
| 4,664,461 | 5/1987 | Schubert et al. | 439/587 |
| 4,842,540 | 6/1989 | Endo et al. | 439/271 |
| 5,334,039 | 8/1994 | Kanda | 439/271 |
| 5,447,446 | 9/1995 | Miller | 439/281 |

FOREIGN PATENT DOCUMENTS 245975 11/1987 European Pat. Off. .

89/04072 5/1989 WIPO .

*Primary Examiner*—S. Thomas Hughes
*Attorney, Agent, or Firm*—William R. Clark

[57] ABSTRACT

An environmental connector formed by insert molding a thermoplastic rubber insert into a plastic cylindrical housing having an external shoulder adjacent to an exit aperture for the thermoplastic rubber to flow to an annular void in the cavity of the mold. In such manner, an annular ring such as a gasket or o-ring is formed by the insert molding process, and is connected as one piece with the thermoplastic rubber insert formed in the internal chamber of the housing. The housing is made of polypropylene and the thermoplastic rubber is Santoprene so the two materials stick together to hold the annular ring snugly against the shoulder. The insert of the female connector has a concentric opening to receive the housing of the male connector, and the concentric opening terminates in thin protrusion that is compressible to from an inner seal to prevent the ingress of moisture into the connectors.

9 Claims, 5 Drawing Sheets

ENVIRONMENTAL CONNECTOR

BACKGROUND OF THE INVENTION

The invention generally relates to electrical connectors, and more particularly relates to weather-tight connectors adapted for outdoor use in damp or wet environmental conditions.

As is well known, there are many applications for electrical connectors. For example, electrical connectors are commonly used to connect or disconnect electrical cables such as at a panel of an assembly. In particular, one connector called a panel connector is mounted to a panel, and a mating connector can be connected to or disconnected from it. Either one of the two connectors can be a plug or male connector, and the other connector would be a socket or female connector.

In the typical arrangement, the panel connector has an outer housing with an external annular flange. During installation, the barrel of the housing is inserted through a corresponding hole in the panel until the flange seats against the panel, and then a nut is tightened onto threads on the barrel until the nut engages the panel. In short, the panel is sandwiched between the nut and the flange to secure the panel connector to the panel. In one prior art arrangement, elongated conductive contacts are held parallel by a holder or contact retention disc, and the contacts extend axially through respective bores of an insulator body disposed within a connector housing. The mating connector is of similar construction without the external flange, and its conductive contacts are of opposite type to provide male to female engagement.

Some prior art connectors have been adapted for outdoor use in wet or damp environmental conditions. In particular, molded thermoplastic rubber gaskets have been provided for slipping over the barrel and up against the flange of the panel connector before mounting. Therefore, when the nut is tightened onto the barrel, the gasket is sandwiched between the panel and the flange to provide a seal to prevent passage of moisture through the connector hole to the back of the panel. One drawback of such arrangement is that there must be clearance between the gasket and the barrel of the panel connector to enable the gasket to be slipped on easily. However, this clearance enables the gasket to slip one way or the other so that the barrel is not centered within the gasket. Such arrangement can lead to a faulty seal that permits the passage of moisture through the panel hole to the back of the panel which typically is inside a chassis. Furthermore, such arrangement involves technician labor time in slipping on the gasket, and there is always the possibility that the gasket will inadvertently be omitted.

Environmental or outdoor connectors have also been provided with o-rings that are to be seated against an external shoulder of one of the connectors. The o-ring is then compressed by engagement with the other connector to provide a seal thereby preventing ingress of moisture inside the connector housings to the electrical contact regions of the respective mating connectors. One drawback is that these o-rings may slip from their intended positions. Also, they involve labor time for installation, and there is always a possibility that they will inadvertently be omitted.

SUMMARY OF THE INVENTION

In accordance with the invention, a polypropylene outer housing of an electrical connector is positioned in the cavity of an insert mold, and thermoplastic rubber is injected to form a rubber insert of predetermined shape within the housing. Also, the housing has an aperture adjacent to an external shoulder, and an annular void is provided in the mold of the cavity so that the thermoplastic rubber will flow out of the aperture and around the housing to fill the void. In such manner, an annular ring such as a gasket or o-ring is formed against the shoulder as part of an insert molding process. The annular ring is connected to and is a one piece construction with the rubber insert on the inside of the housing. The mold also has at least one, and preferably a plurality of posts extending axially through the housing so that axial bores are provided in the rubber insert. Electrical contacts are then inserted through the respective bores to form an electrical connector.

It is preferable that the housing further have an injection port through which the thermoplastic rubber is injected, and that the thermoplastic rubber comprise Santoprene. It is also preferable that the electrical contacts be inserted into a contact holder before insertion into the bores of the housing. During installation of the connector, wires of a cable are connected to the electrical contacts. It is also desirable that a cable clamp be connected to the housing of the mating connector, and that the cable clamp include a clamp member that is affixed to the housing of the cable clamp by a living hinge prior to being activated by forcing it radially inward through a slot until its ears secure it in a cable locking position. Further, it is preferable that the thermoplastic rubber insert of the female connector have an annular rim protrusion to engage against the rim of the of the male connector housing to provide a seal. Thus, in conjunction with an o-ring seal between a shoulder of the male connector housing and the rim of the female connector housing, a double seal arrangement is provided.

With such arrangement, environmental or outdoor connectors are provided with external annular rings such as gaskets or o-rings as part of an insert molding process, so additional labor for installing such rings is not required, and installation of such rings will not inadvertently be omitted. Further, the gaskets or o-rings engage the barrel of the housing, so they are not free to slip from their intended positions to permit leakage or ingress of moisture. Also, when polypropylene is used for the housing and Santoprene is used for the insert molding material, the two materials stick together so the gaskets or o-rings are securely fixed to the flanges or shoulders. Also, use of a living hinge on the cable clamp means that the locking members will not be lost or misplaced before activation.

BRIEF DESCRIPTION OF THE DRAWINGS

The foregoing objects and advantages will be more fully understood by reading the following Description of the Preferred Embodiment with reference to the drawings wherein.

DESCRIPTION OF THE PREFERRED EMBODIMENT

Figure 1:
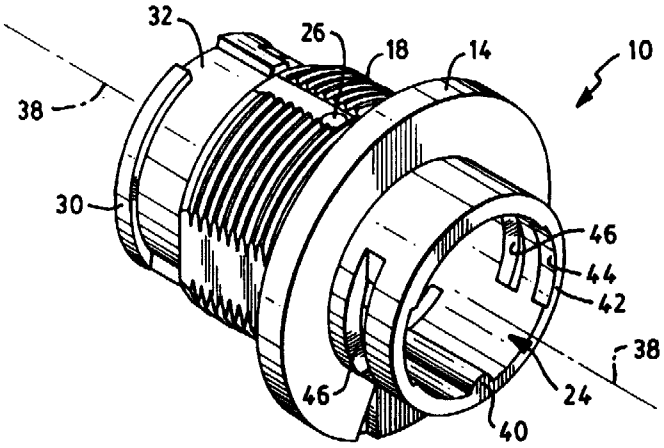
FIG. 1 is a rear perspective view of a panel connector housing.
Figure 2:
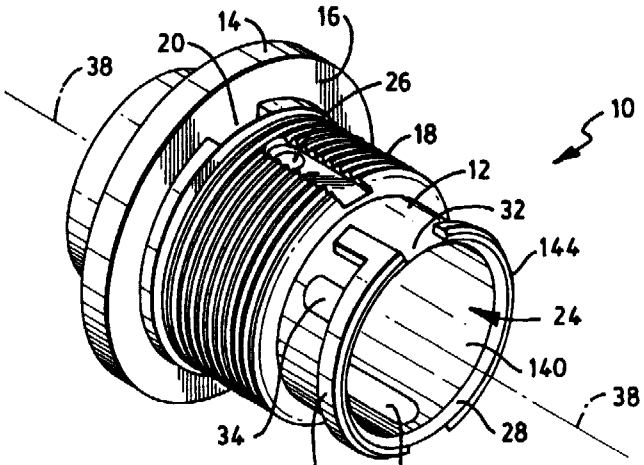
FIG. 2 is a front perspective view of the housing of FIG. 1.

Referring to FIGS. 1 and 2, rear and front perspective views of panel connector housing 10 are shown. Here, housing 10 is fabricated by an injection molding process using a plastic material, preferably polypropylene. Housing 10 has a generally hollow cylinder or barrel 12 which has an external annular flange 14 with a shoulder 16. Barrel 12 has threads 18 on a front portion thereof, and an aperture 20 or passageway communicates from internal chamber 24 of housing 10 to a location immediately adjacent to the shoulder 16 of flange 14. Barrel 12 further has an injection aperture or port 26 for insert molding which will be described in detail later herein. The front end 28 has an angled rib 30 with an entrance channel 32 which, along with override locking boss 34, functions to mate with coupling ring 36 (FIG. 8) in a manner to be described.

Housing 10 has a longitudinal axis 38 along which coaxial keyway 40 extends. Further, as shown in FIG. 1, the back end 42 of housing 10 has opposing guide grooves 44 that are tapered in depth and lead to locking slots 46 which are adapted to receive resilient ears 48 (FIG. 7) of contact locking disc 50 in a manner to be described.

Figure 3:
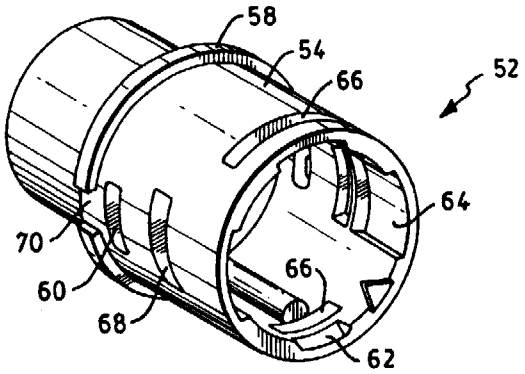
FIG. 3 is a rear perspective view of a mating connector housing for the panel connector housing shown in FIGS. 1 and 2.
Figure 4:
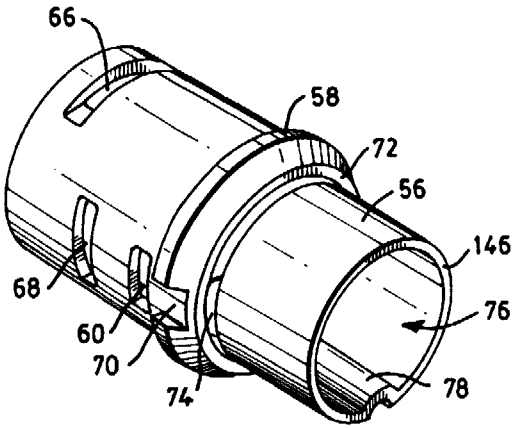
FIG. 4 is a front perspective view of the mating connector housing of FIG. 3.

Referring to FIGS. 3 and 4, a mating connector housing 52 is shown in respective rear and front views. Housing 52 is constructed in a similar manner to panel connector housing 10 using polypropylene in an injection molding process. Housing 52 is generally a hollow cylinder or barrel 54, with a flange 58 and a forward portion 56 of reduced diameter. Housing 52 has an injection aperture or port 60 and opposing pairs of guide grooves 62 and 64 that are tapered in depth and extend to respective pairs of locking slots 66 and 68. Flange 58 has a locator notch 70 to precisely orient housing 52 in insert mold 82 (FIG. 6) to be described. Flange 58 has a shoulder 72 located adjacent to aperture 74 which communicates with internal chamber 76 of housing 52. Flange 58 is sloped to enable installation of coupling ring 36 in a manner to be described. Housing 52 further has a female keyway 78.

Figure 5:
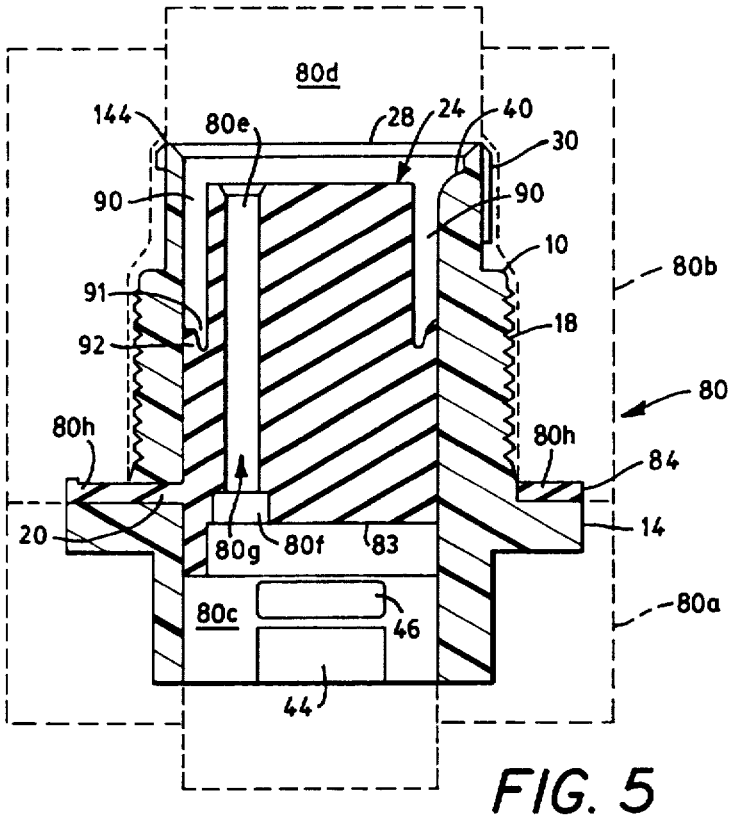
FIG. 5 is the panel connector housing shown in an insert mold after injection of a thermoplastic rubber.
Figure 6:
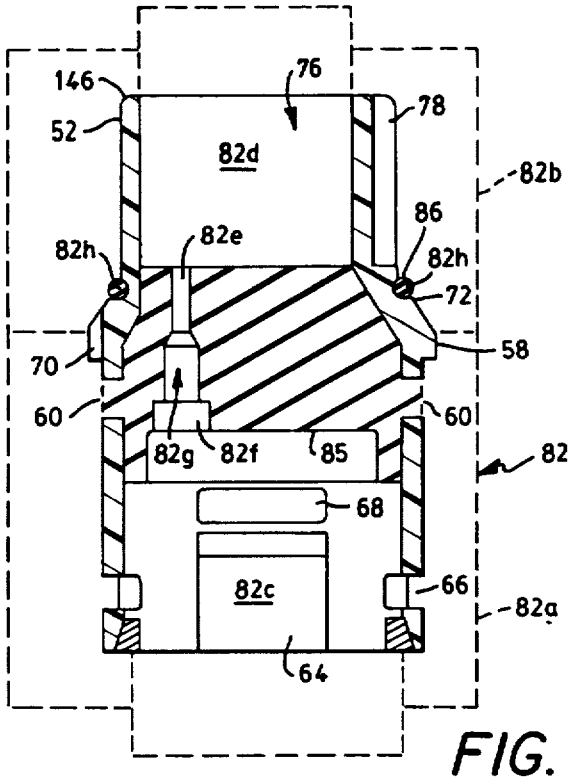
FIG. 6 is the mating connector housing shown in an insert mold after injection of a thermoplastic rubber.

Referring to FIGS. 5 and 6, panel connector housing 10 and mating connector housing 52 are positioned in the respective cavities or pockets of insert molds 80 and 82. Each insert mold 80 and 82 includes a base portion **80*a* or 82*a* in which the respective housing 10 or 52 is seated, and a respective upper portion 80*b* or 82*b* which is lowered down on the respective base portion 80*a* or 82*a*. Further, each mold 80 and 82 includes lower and upper inner portions 80*c–d* and 82*c–d* that define a predetermined shape within respective internal chambers 24 and 76. In particular, lower and upper inner portions 80*c–d* and 82*c–d* define whether a socket or a plug connector is formed, and also define the number and locations of electrical contacts or pins in the connector. For example, although the female/male types could be reversed, panel connector housing 10 of FIG. 5 is here formed for a socket or female connector, and mating connector housing 52 of FIG. 6 is here formed for a plug or male connector. Upper and lower inner portions 80*c–d* and 82*c–d* have respective elongated interconnecting members 80*e–f* and 82*e–f* that form axial posts 80*g* and 82*g* through a central region within respective chambers 24 and 76. The number and location of posts 80*g* and 82*g* corresponds to the number of pins or electrical contacts desired in the connector because, as will be described, the posts 80*g* and 82*g* are used to form bores 88 (FIG. 7) in which the conductive contacts 95*a* or 95*b* (FIGS. 7 and 8) are inserted. Further, respective upper portions 80*b* and 82*b* have respective annular voids 80*h* and 82*h* adjacent to respective shoulders 16 and 72**.

In accordance with an insert molding process, injector nozzles (not shown) in respective upper portions **80*b* and 82*b* are coupled to respective injection ports 26 and 60, and a thermoplastic rubber such as Santoprene is injected through injection ports 26 and 60 into internal chambers 24 and 76. As shown in FIGS. 5 and 6, the thermoplastic rubber fills a portion of internal chambers 24 and 76 in a predetermined shape according to respective molds 80*c–d* and 82*c–d*. More specifically, a body or insert 83 and 85 of an electrically insulating material is formed in a predetermined shape. Also, in accordance with the invention, the thermoplastic rubber flows from respective internal chambers 24 and 76 out through respective apertures 20 and 74, and then flows around respective housings 10 and 52 to fill annular voids 80*h* and 82*h* adjacent to respective shoulders 16 and 72. Thus, respective external annular rings 84 and 86 are formed around respective housings 10 and 52, and rings 84 and 86 are interconnected and formed in one piece construction with the respective inserts 83 and 85 of thermoplastic rubber. With reference to FIG. 5, the ring 84 here functions as gasket of resilient water resistant material. With reference to FIG. 6, the ring 86** here functions as an O-ring of resilient water resistant material.

The housings 10 and 52 and inserts 83 and 85 along with annular rings 84 and 86 are then removed from the insert molds 80 and 82. The regions formerly occupied by the posts **80*g* and 82*g* now form axial bores 88 (FIG. 7) extending through inserts 83 and 85. Still referring to FIG. 5, there is a concentric opening 90 or passageway between insert 83 and housing 10, and opening 90 terminates in an annular channel 91 in insert 83 which forms a radially thin annular rim protrusion 92**.

Figure 7:
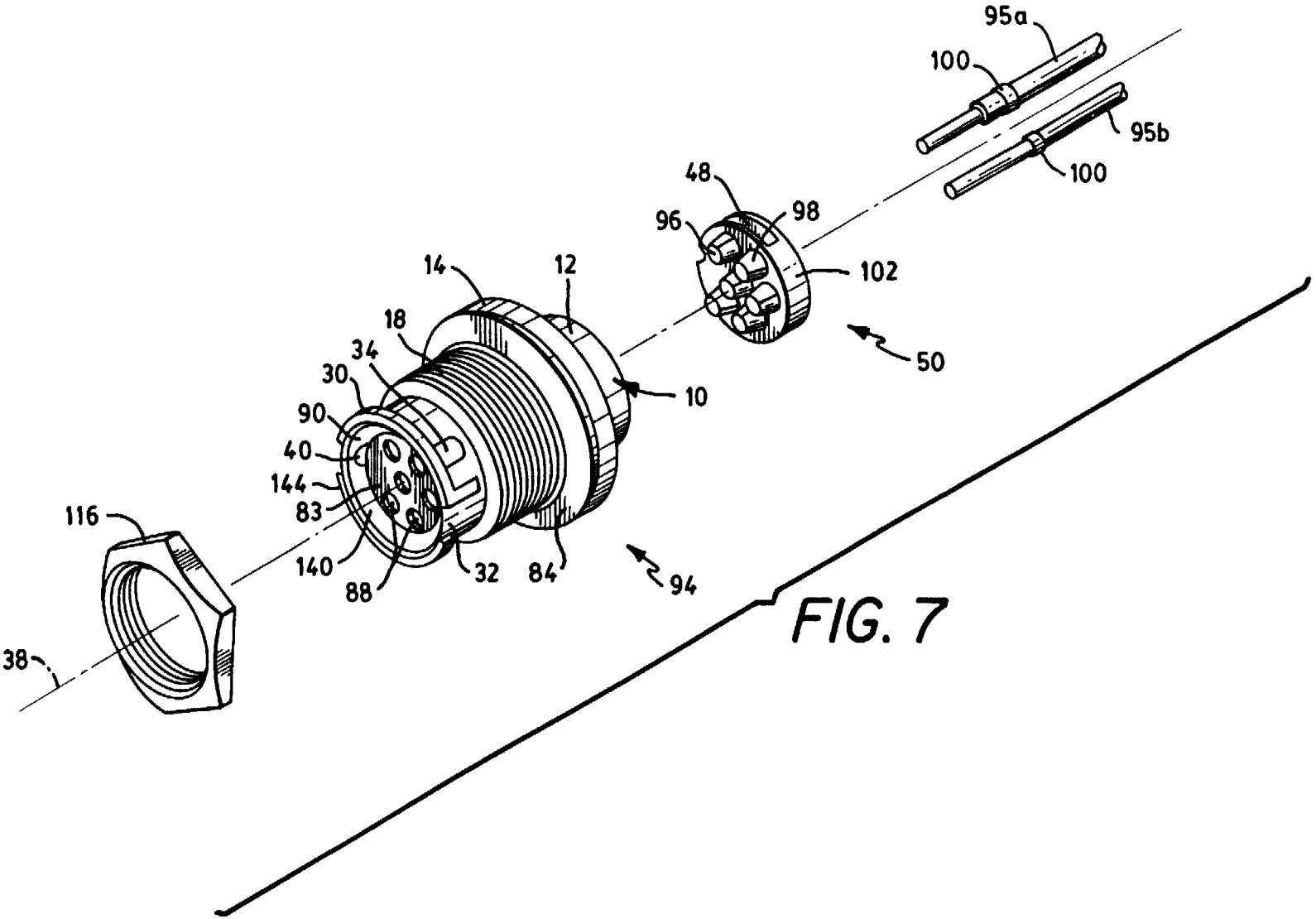
FIG. 7 is an exploded view of a panel connector.

Referring to FIG. 7, an exploded view of panel connector 94 shows male and female electrical contacts **95*a* and 95*b* because either type could be used depending on the type of insert 83 molded into housing 10. Here, insert 83 is shown and described to be a female type, so female electrically conductive contacts 95*b* or pins would be used. In fabrication, female conductive contacts 95*b* or pins are inserted into contact locking disc 50 which serves as a contact holder. Contacting locking disc 50 has a plurality, here six, of apertures 96 each surrounded by resilient wings 98 that spread as a conductive contact 95*b* is inserted therethrough. An annular rib 100 of the conductive contact 95*b* spreads the resilient wings 98 which snap back in after the annular rib 100 passes therethrough to secure the conductive contact 95*b* in the locking disc 50. Contact locking disc 50 has resilient ears 48 which protrude from opposing edges 102. Resilient ears 48 are received in sliding engagement in guide grooves 44 of housing 10. As the contact locking disc 50 with conductive contacts 95*b* is pushed into housing 10, the contacts 95*b* are received in respective bores 88, and the resilient ears 48 depress until aligned with slots 46. In this position, the resilient ears 48 snap outwardly to securely engage contact locking disc 50 and the conductive contacts 95*b* within panel connector housing 10. This completes the description of the fabrication of panel connector 94**.

Figure 8:
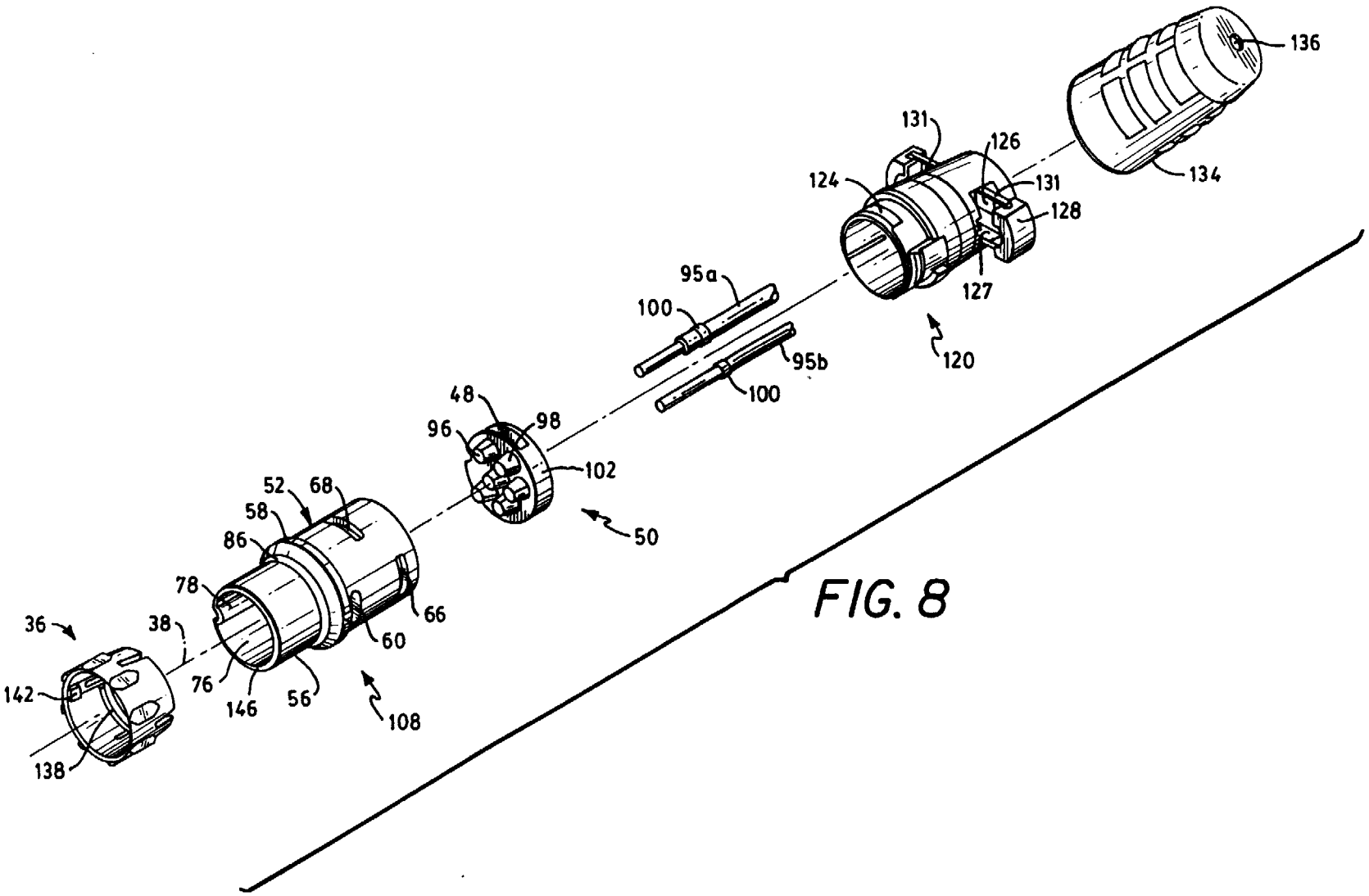
FIG. 8 is an exploded view of a mating connector.

Referring to FIG. 8, an exploded view of a mating connector 108 for connector 94 also shows male and female electrical contacts 95*a* and 95*b* because either type could be used depending on the type of insert 85 molded into housing 52. Here, insert 85 is shown and described to be a male type, so male electrically conductive contacts 95*a* or pins would be used. As described with reference to FIG. 7, the conductive contacts, here male contacts 95*a*, are inserted into contact locking disc 50 which is then inserted into housing 52. In particular, resilient ears 48 of contact locking disc travel in guide grooves 64 until ears 48 snap into locking slots 68. The contact locking disc 50 is so secured, and the conductive contacts 95*a* extend through bores 110 (FIG. 9) in insert 85.

Figure 9:
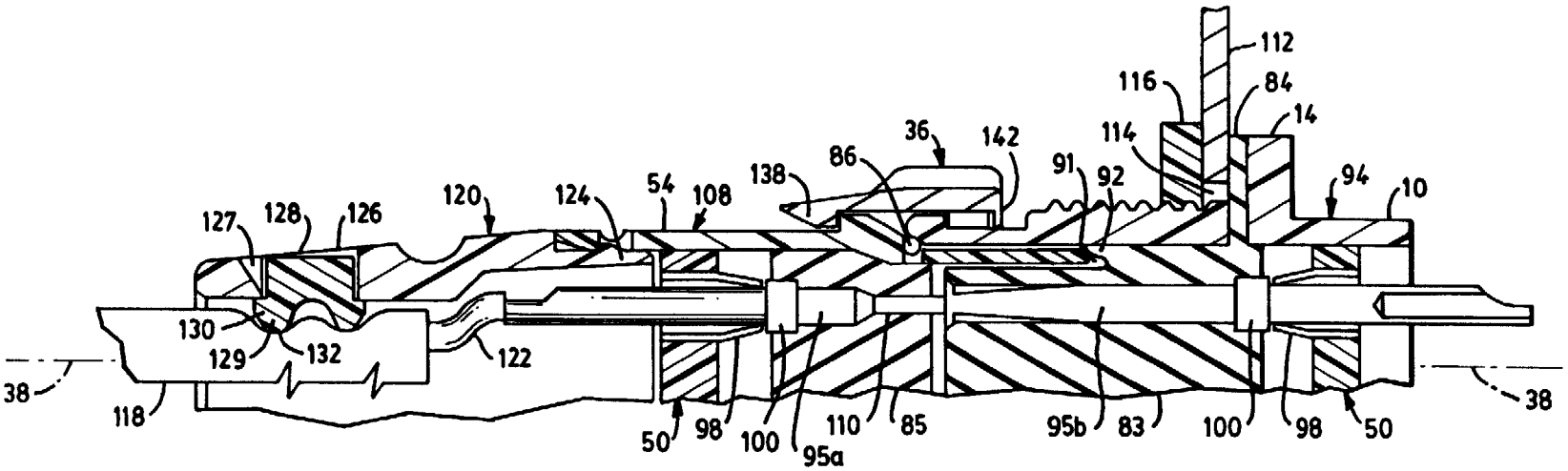
FIG. 9 is a cross section view of the panel connector mated with the mating connector.

Referring to FIG. 9, a cross-sectional view shows connectors 94 and 108 mated together at panel 112. In assembly, connector 94 is first attached to panel 112. As described earlier in the Background of the Invention section, the threaded portion of barrel 12 is inserted through a corresponding circular hole 114 in panel 112 until gasket ring 84 seats against the inside surface of the panel 112, and then nut 116 is threaded onto threads 18 until nut 116 firmly engages the outside surface of the panel 112. With such arrangement, gasket ring 84 is compressed between the shoulder 16 of flange 14 and the panel 112 to provide a watertight seal thereby preventing the ingress of moisture into the assembly of the panel 112.

Still referring to FIG. 9, the next step is to insert cable 118 through cable clamp housing 120, and attach the wire ends 122 to conductive contacts 95*a* of mating connector 108. Now, referring again to FIG. 8, resilient ears 124 on opposing sides of cable clamp housing 120 are inserted in respective guide grooves 62 of housing 52, and forced axially along the grooves 62 until ears 124 snap into locking slots 66 to secure cable clamp housing 120 to mating connector 108. Cable clamp housing 120 is elongated and hollow, and has a notch 126 with tapered side grooves 127. A locking member 128 has tabs 129 with outward and downward projections 130 and 132. Locking member 128 is connected to cable clamp housing 120 with a living hinge 131, and the technician seats tabs 129 in respective side grooves 127 and forces locking member 128 radially inward until outward protrusions 130 snap under the internal surface of housing 130 to secure locking member in place. In such locked position, the downward projections 132 depress cable 118 to provide strain relief. That is, an axial force on cable 118 is transmitted through locking member 128 to cable clamp housing 120 and mating connector 108 to resist forces being applied to the connections between wire ends 122 and conductive contacts 95*a*. A similar strain relief assembly may not be necessary for panel connector 94 because cables inside the panel 112 are not generally accessible for applying a force. Still referring to FIG. 8, a rubber boot 134 with a membrane seal 136 is then slid over mating connector 108 and cable clamp housing 120 prevent ingress of moisture thereto. Finally, an internal annular lip 138 of coupling ring 36 is slipped over flange 58 of mating connector housing 52.

Referring again to FIG. 9, mating connector 108 is coupled to panel connector 94 by inserting forward portion 56 of housing 52 into the throat 140 of housing 10. Proper rotational alignment of housing 10 to housing 52, and of contact locking discs 50 in respective housings 10 and 52 is ensured by respective male and female keyways 40 and 78. Male conductive contacts 95*a* protruding from insert 85 are received in female conductive contacts 95*b* in bores 88 of panel connector 94. In conventional manner, tab 142 of coupling ring 36 inserts through channel 32, and a twisting action causes tab 142 to travel along angled rib 30 thereby drawing connector 108 into connector 94 with tab 142 eventually passing over override locking boss 34 to lock the two connectors 94 and 108 together. In the locked position, the front rim 144 of panel connector housing 10 engages and compresses o-ring 86 against shoulder 72 to provide a watertight seal. Further, as shown, the front rim 146 of mating connector housing 52 engages and compresses annular rim protrusion 92 of insert 83 to form a second seal. Thus, a double seal is provided to prevent the ingress of moisture into the region of contacts 95*a* and 95*b*.

This concludes the Description of the Preferred Embodiment. However, a reading of it by one of skill in the art will bring to mind many alterations and modifications that do not depart from the spirit and scope of the invention. For example, although a panel connector has been described, the invention can be practiced to advantage with a variety of other types of electrical connectors. Therefore, it is intended that the scope of the invention be limited only by the appended claims.

What is claimed is:

1. A method of making an electrical connector, comprising the steps of:

forming a plastic housing having an axis and being formed with an axial chamber extending between opposing open ends, said housing having an external annular shoulder and an aperture adjacent to said shoulder;

positioning said housing in a cavity of an insertion mold having at least one post extending axially through said chamber of said housing, said cavity having an annular void adjacent to said shoulder;

injecting thermoplastic rubber into said chamber of said housing to form a rubber insert of predetermined shape within said housing and around said at least said one post, and to cause said thermoplastic rubber to flow out of said aperture and around said housing in said annular void to form an annular ring against said shoulder wherein said insert and said ring are interconnected as one piece;

removing said housing and insert from said cavity and away from said at least one post to form at least one axial bore through said insert within said chamber in the space vacated by said at least one post; and inserting at least one conductive contact into said bore.

2. The method recite in claim 1 wherein said plastic is polypropylene.

3. The method recited in claim 1 wherein said forming step comprises a step of forming an injection port in said housing, and said injecting step comprises a step of injecting said thermoplastic rubber into said chamber through said injection port.

4. The method recited in claim 1 wherein said ring comprises an O-ring for said connector.

5. The method recited in claim 1 wherein said housing comprises an outer annular flange forming said shoulder, and said ring comprises a gasket against said flange.

6. The method recited in claim 1 wherein said insertion mold has a plurality of posts to form a plurality of bores through said insert, and said method further comprises a step of inserting a plurality of conductive contacts in a contact holder and inserting the contact holder into said chamber through one of said open ends to cause said plurality of contacts to be received in corresponding ones of said bores in said insert.

7. The method recite in claim 6 further comprising steps of attaching electrical wires from a cable to said contacts, and attaching a cable clamp to said housing.

8. The method recited in claim 2 further comprising a step of selecting a thermoplastic rubber that sticks to said polypropylene housing.

9. A method of making an electrical connector, comprising the steps of:

forming a substantially tubular polypropylene housing having an elongated hollow chamber extending between opposing open ends, said housing having an external annular flange and an aperture adjacent to said flange;

positioning said housing in a cavity of an insertion mold having a predetermined plurality of posts extending axially through said chamber of said housing, said cavity having an annular void adjacent to said flange on the outside of said housing;

injecting thermoplastic rubber into said chamber of said housing to form a rubber insert of predetermined shape within said housing around said posts, and to cause said thermoplastic rubber to flow from said chamber through said aperture and around said housing in said annular void to form an annular gasket against said flange wherein said insert and said gasket are interconnected as one piece;

removing said housing and insert from said cavity and away from said plurality of posts to form a plurality of axial bores through said insert in the space vacated by said plurality of posts; and inserting a plurality of conductive contacts into said plurality of bores, respectively.

* * * * *